US010380978B2

(12) United States Patent
Lakat et al.

(10) Patent No.: US 10,380,978 B2
(45) Date of Patent: Aug. 13, 2019

(54) FLUTE HEADJOINT

(71) Applicants: Zoltan Lakat, Pecs (HU); Tamas Horvath, Pecs (HU)

(72) Inventors: Zoltan Lakat, Pecs (HU); Tamas Horvath, Pecs (HU)

( * ) Notice: Subject to any disclaimer, the term of this patent is extended or adjusted under 35 U.S.C. 154(b) by 0 days.

(21) Appl. No.: 15/769,029

(22) PCT Filed: Oct. 4, 2016

(86) PCT No.: PCT/HU2016/000066
§ 371 (c)(1),
(2) Date: Apr. 17, 2018

(87) PCT Pub. No.: WO2017/068380
PCT Pub. Date: Apr. 27, 2017

(65) Prior Publication Data

US 2018/0308459 A1 Oct. 25, 2018

(30) Foreign Application Priority Data

Oct. 19, 2015 (HU) ..... 1500480

(51) Int. Cl.
*G10D 9/02* (2006.01)
*G10D 7/02* (2006.01)

(52) U.S. Cl.
CPC ..... *G10D 9/02* (2013.01); *G10D 7/026* (2013.01)

(58) Field of Classification Search
CPC ..... G10D 9/02; G10D 7/026
See application file for complete search history.

(56) References Cited

U.S. PATENT DOCUMENTS 8,653,347 B1 * 2/2014 Lewis ..... G10D 9/00 84/384

* cited by examiner

*Primary Examiner* — Kimberly R Lockett
(74) *Attorney, Agent, or Firm* — Olson & Cepuritis, Ltd.

(57) ABSTRACT

A flute headjoint includes a cylindrical pipe section (2), an embouchure hole (3) bounded by a reinforcing element (4), a crown (6) terminating the pipe section (2) situated to the left of the embouchure hole (3), and a concave tuning plug (8) disposed in the pipe section (2) in a sonic chamber (5) situated under the embouchure hole (3). The cylindrical pipe section (2) is longer compared to conventional configurations, the crown (6) is open, the tuning plug (8, 12, 15, 23) is a cylindrical body with its face situated facing the embouchure hole (3) having a sunken three-dimensional configuration made as a combination of regular or irregular arcuate and flat faces. A balance weight (40) is positioned in the resonator cavity (5*a*) between the tuning plug (8, 12, 15, 23) and the crown (6). Pipe section (2) includes an additional extension piece (42, 43) which is removable

18 Claims, 7 Drawing Sheets

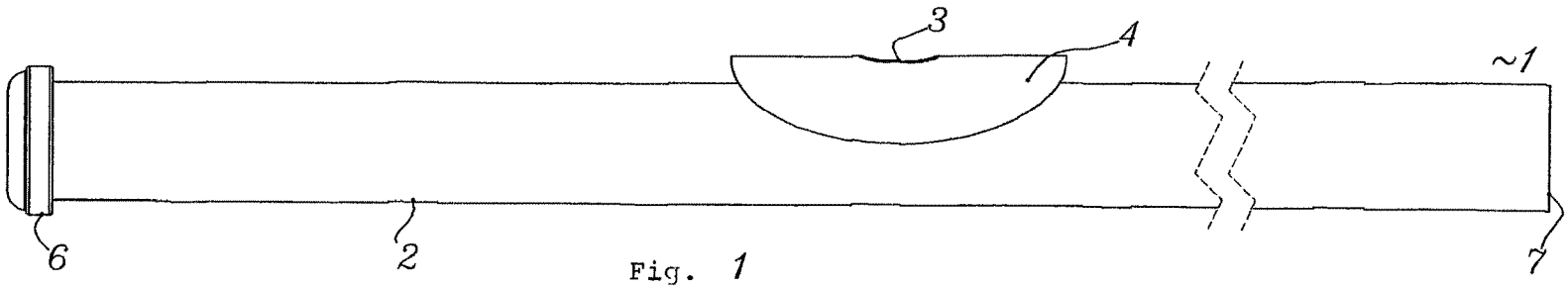
Fig. 1
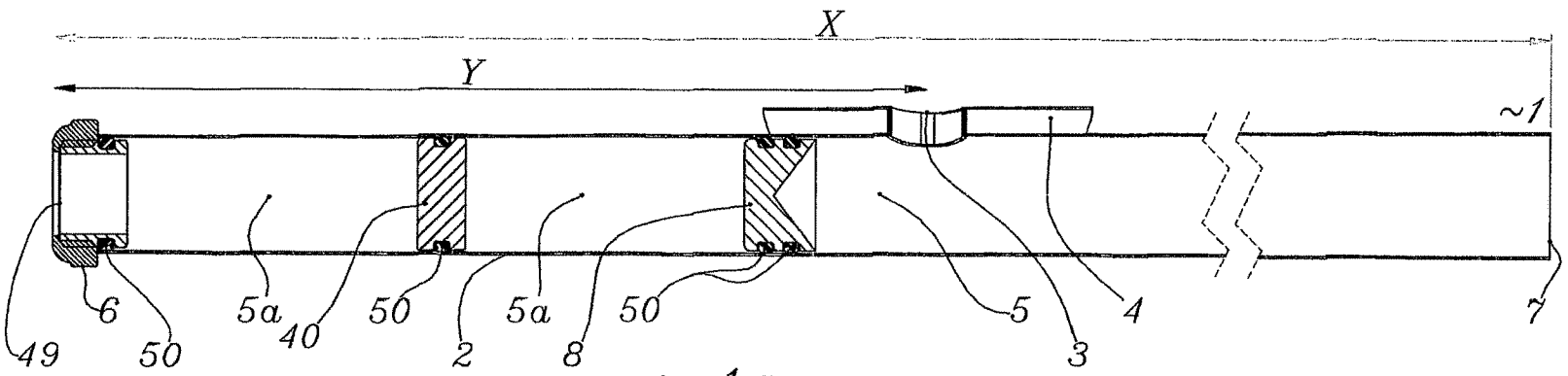
Fig. 1.a.

FLUTE HEADJOINT

CROSS-REFERENCE TO RELATED APPLICATIONS

This application is a U.S. National Stage of PCT/HU2016/000066, filed on Oct. 4, 2016, which claims priority of Hungarian Patent Application No. P1500480, filed on Oct. 19, 2015, each of which is incorporated herein by reference.

TECHNICAL FIELD OF THE INVENTION

The invention relates to a flute headjoint comprising a cylindrical pipe section, an embouchure hole bounded by a reinforcing element, a crown adapted to terminate the pipe section situated to the left of the embouchure hole, and a concave tuning plug disposed in the pipe section in a sonic chamber situated under the embouchure hole.

BACKGROUND ART

Th. Böhm, the inventor of the modern flute modernized almost every component of the instrument, but he kept unchanged the tuning plug disposed in the flute headjoint and the crown adapted to close off the flute headjoint. The tuning plug is typically made of cork—even in the most expensive handmade instruments—with a plate made typically of metal being added to it by most manufacturers. The sound quality of the flute primarily depends on the quality of the headjoint.

Due to the presence of the cork, the left-hand side of the flute headjoint is an acoustically passive "mute" pipe section. The heart of the instrument is the sonic chamber situated under the embouchure hole. The sonic chamber is a region of the headjoint approximately 4 cm across, with the sound propagating from the centre thereof towards the open end of the pipe. Due to the material of the tuning plug the left-hand side of the headjoint is acoustically inoperative in its conventional state, the instrument therefore emitting sound in the forward and right-hand directions. A material characteristic of cork is that it absorbs a fraction of sounds and oscillations.

Efforts have been made to eliminate the disadvantages caused by the cork material. Thus, the patent description U.S. Pat. No. 6,660,919 discloses a solution wherein the closed crown, the screw shaft and tuning plate, together with a portion of the cork, are retained. The stable retention of the tuning plug is provided by an additional insert adapted for receiving the screw shaft, which metal insert improves the sound of the flute, albeit to a small extent.

This solution has the disadvantage that the upper pipe section still remains muffled by the cork and the closed-off tuning plug.

Since 2012 the Japanese flute maker Nagahara has been selling such flute headjoints wherein a plug and balance weight made for silver headjoints are applied, with the customers being able to choose the components that best suit their needs. Although this configuration facilitates the use of the instrument, the closed crown and the cork muffle the sound.

Other solutions applying replaceable tuning plugs but retaining the cork inside the headjoint are also known.

Robert Bigio was the first flute maker to completely discard cork and to apply a metal tuning plug with a closed crown. He built the balance weight into the crown.

The disadvantage of his design is that the tuning plate still has a flat face.

The objective of the present invention is to provide a flute headjoint that eliminates the disadvantages of conventional headjoints, namely that

- the flat tuning face applied inside the flute headjoint is less suitable for notes with accidentals,
- when played softly, the flute typically sounds flat, while it is usually sharp when played loudly,
- high-pitch notes are unstable, their resonance being unable to sustain a clear tone, and therefore constant pitch compensation is required,
- low-pitch notes are difficult to play in a forte passage, while high-pitch notes have to be blown strongly, which strains the concentration of the player,
- conventional flutes emit sound only in the forward and right-hand directions.

The present invention is based on the recognition that by applying a three-dimensional, concave tuning surface instead of a flat surface an improved, clearer sound can be achieved. With an open crown the flute also emits sound in the left-hand direction.

DISCLOSURE OF THE INVENTION

The objective of the invention is fulfilled by providing a flute headjoint comprising a cylindrical pipe section, an embouchure hole bounded by a reinforcing element, a crown adapted for terminating the pipe section situated to the left of the embouchure hole, and a concave tuning plug disposed in a sonic chamber situated under the embouchure hole, characterised in that the cylindrical pipe section is longer compared to conventional arrangements, the crown has an open configuration, the tuning plug is a cylindrical body with its surface facing the embouchure hole having a sunken three-dimensional configuration made as a combination of regular or irregular arcuate and flat faces, the pipe section between the embouchure hole and the crown is longer compared to conventional solutions, and the headjoint comprises a balance weight adapted to be placed in the resonator cavity between the tuning plug and the crown.

In a preferred embodiment of the flute headjoint according to the invention the crown consists of two hollow portions: a bottom portion and an upper portion; with a membrane being disposed between the bottom and upper portions, a groove being disposed on the cylindrical surface of the bottom portion, and with the bottom and upper portions being joined together by a releasable connection.

In another preferred embodiment of the flute headjoint according to the invention the tuning plug is a cylindrical body comprising grooves adapted for receiving rubber rings disposed on the cylindrical body, with the surface of the tuning plug facing the embouchure hole having an inwardly tapering configuration.

In a further preferred embodiment of the flute headjoint according to the invention the tuning plug is a cylindrical body comprising grooves disposed on its cylindrical surface, with its face facing the embouchure hole being formed of an inner conical portion, a frustum-shaped portion, and a concave flared portion.

The tuning plug of an expedient embodiment of the flute headjoint according to the invention consists of two portions, an upper and a bottom portion, where the upper portion of the tuning plug is formed of a stem portion and an upwardly tapering portion joined to the stem portion via an intermediate portion. A recess consisting of an inner conical portion, a frustum-shaped portion, and a concave flared portion is disposed in the interior of the upper portion, with a connection cavity extending along the entire height of the bottom portion being disposed in the bottom portion, where the upper and bottom portions of the tuning plug are firmly joined together, or the bottom and upper portions are joined together by a releasable connection.

In another expedient embodiment of the flute headjoint according to the invention the upper portion of the tuning plug consists of a head portion, a stem portion, a cylindrical portion, and an outwardly tapering portion terminated in a cylindrical portion. In the interior of the upper portion there is disposed a recess consisting of an inner conical portion, a frustum-shaped portion, and a concave flared portion, with an inner bore adapted for receiving the upper portion and a conical portion connected to the bore being disposed in the bottom portion, and a releasable connection, preferably implemented utilizing a rubber ring, being disposed between the upper and bottom portions of the tuning plug.

All preferred embodiments of the flute headjoint according to the invention comprise a balance weight adapted to be inserted into the resonator cavity between the tuning plug and the crown, and further comprise an additional extension piece, the balance weight being a disc- or ring-shaped body comprising one or more grooves adapted for receiving a rubber ring disposed on its external surface.

In a preferred embodiment of the flute headjoint according to the invention the extension piece is a thin-walled pipe, with a groove being disposed at one end, and with the other end being adapted for receiving the crown, while in another preferred embodiment the extension piece is a thin-walled pipe, with the end thereof that is connected to the flute headjoint having a tapering configuration, and the other end being adapted for receiving the crown.

In all preferred embodiments of the flute headjoint according to the invention the crown, the tuning plug, the balance weight, and the extension piece are made of gold, silver, alpaca, copper, brass, aluminium, zirconium, steel, titanium, platinum, plastic, wood, bone, etc., the crown, tuning plug, and balance weight being provided with anti-corrosion coating if so required.

In all preferred embodiments of the flute headjoint according to the invention the crown, the tuning plug, the balance weight, and the extension piece are attached to the flute headjoint by means of respective rubber rings disposed in grooves machined in the cylindrical outside surface.

BRIEF DESCRIPTION OF THE DRAWINGS

Preferred embodiments of the flute headjoint according to the invention are explained in detail referring to the attached drawings, where FIG. 1 shows a view of the flute headjoint according to the invention, FIG. 1*a* shows a partial section view of the flute headjoint according to the invention.

BEST MODE OF CARRYING OUT THE INVENTION

Figure 2:
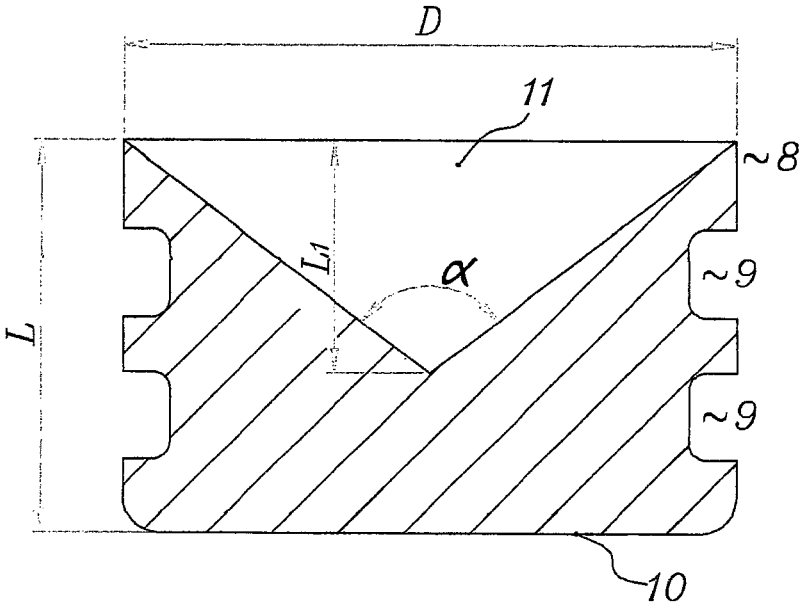
FIG. 2 shows in section view an embodiment of the tuning plug of the flute headjoint according to the invention.

In FIG. 1 a view of the flute headjoint 1 according to the invention is shown, which consists of a pipe section 2 configured similarly to, but longer than conventional headjoints, with an element 4 bounding an embouchure hole 3 being disposed on the pipe section 2. A so-called sonic chamber 5 is disposed in the part of the pipe section 2 of the flute headjoint 1 situated under the embouchure hole 3. The sonic chamber 5 is terminated at the side facing the crown 6 by a so-called tuning plug 8. The sonic chamber 5 is essentially a region with an approximate size of 4 cm, with the air blown in through the embouchure hole 3 flowing in the direction of the free end 7 of the pipe section 2 through the middle of this region. The body of the flute with the keywork adapted for playing the instrument is attached to the free end of the pipe section 2 of the flute headjoint 1. In the region of the flute headjoint 1 near the crown 6 there is situated a tuning plug 8. The blown-in air collides against this plug and, taking a "u-turn" it flows in the direction of the free end 7.

In conventional flutes a fraction of the sound and oscillations is absorbed at this pipe section due to the configuration of the tuning plug 8. The tuning plug 8 applied with the flute headjoint 1 according to the invention is adapted for eliminating this effect, with the application of further additional components and configuration modifications allowing for improving the sound of the flute.

FIG. 1*a* is a partial section view of the flute headjoint 1 according to the invention, where the size of the full pipe section is X=220-450 mm, with the pipe section situated to the left of the embouchure hole 3 being significantly longer than usual, having a length of Y=30-230 mm. In the resonator cavity 5*a* situated between the crown 6 and the tuning plug 8 there is disposed a balance weight 40, the role of which will be addressed later on. As a result of the longer pipe section 2 also the resonator cavity 5*a* is larger, the larger resonator cavity 5*a* having a greater amplification effect on the sound of the flute.

In FIG. 2 the tuning plug 8 of the flute headjoint is illustrated in section view. The tuning plug 8 is a cylindrical body having a diameter of D=9-46 mm (depending on the diameter of the flute headjoint 1), and a height of L=3-120 mm. There are grooves 9 with rounded-off edges situated in the cyldindrical body of the tuning plug 8, with rubber rings—not shown in the drawing—adapted for fixing the tuning plug 8 inside the pipe section 2 of the flute headjoint 1 being placed in the grooves.

Thereby, one, two or more grooves 9 are disposed on the outside surface of the cylindrical portion of the tuning plug 8. The two or more rubber rings placed into respective grooves 9 provide for improved centring of the tuning plug 8.

The bottom end 10 of the tuning plug 8 has a flat surface, while the upper face 11 that is parallel with the end 10 and faces the embouchure hole 3 of the flute headjoint 1 has a three-dimensional configuration, namely, in this embodiment it constitutes an inner conical surface with a cone angle $\alpha$=0-120° and a depth of $L_1$=2-110 mm.

The tuning plug 8 can be made of a wide range of materials including silver, gold, alpaca, copper, brass, zirconium, titanium, platinum, tantalum, bone, wood, or plastic. Metal tuning plugs 8 are preferably coated with rhodium which forms a strong, anti-scratch coating and provides an aesthetically pleasing, brilliant surface finish.

The tuning plug 8 is preferably made of a compact, homogeneous or alloyed material.

Figure 16:
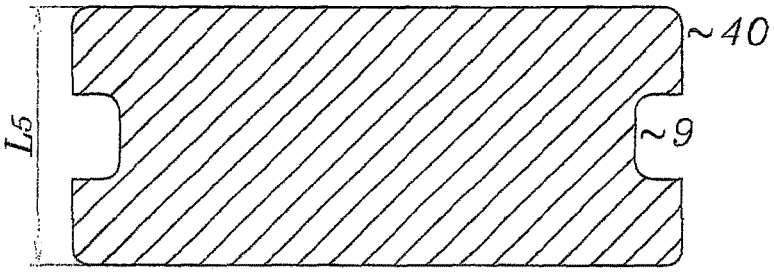
FIG. 16 illustrates the balance weight of the flute headjoint according to the invention.

It should be noted that the tuning plug may also be made of sheet metal, but in that case a balance weight has to be applied in order to improve sound quality (see FIG. 16).

Figure 3:
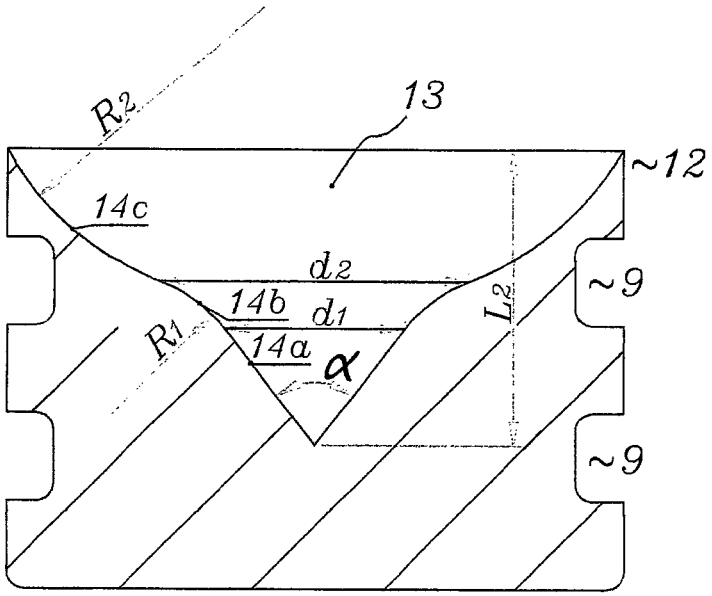
FIG. 3 shows in section view a further embodiment of the tuning plug of the flute headjoint according to the invention.

In FIG. 3 a tuning plug 12 configuration is shown, comprising a gradual-transition three-dimensional configuration of the surface 13 facing the embouchure hole 3 of the flute headjoint 1, the configuration including the conical portion 14*a* that has a cone angle $\alpha$=0-120° mentioned above in relation to FIG. 2 and extends from 3-25 mm to 2-70 mm below the upper face of the tuning plug 12. The diameter $d_1$ of the conical portion 14*a* is 1-30 mm. A frustum-shaped portion 14*b* with a diameter $d_2$ of 2-40 mm is connected to the conical portion 14*a* via a radiused transition section ($R_1$=1-58 mm), with a flared portion 14*c* being connected thereto via a radiused transition section ($R_2$=1-58 mm). This configuration allows for the lower notes of the flute to be sounded more in pitch.

The external configuration of the tuning plug 12 is identical to the external configuration of the tuning plug 8.

It is proved by experimental results that the tuning plug can also have a bimetallic configuration. Such bimetallic tuning plug 15 configurations, made of two or more different metals or metal alloys, are disclosed in FIGS. 4-7 and in FIGS. 8-11.

Figure 4:
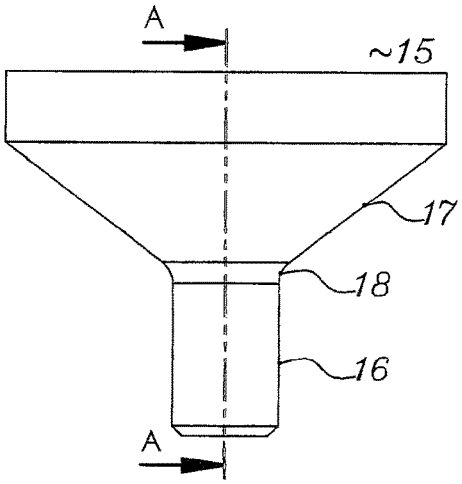
FIG. 4 shows a view of the two-part tuning plug of the flute headjoint according to the invention.
Figure 5:
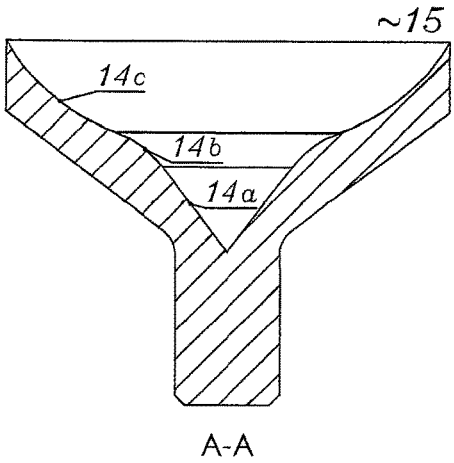
FIG. 5 is a section view of the two-part tuning plug illustrated in FIG. 4 taken along the plane A-A.

FIG. 4 illustrates an upper portion 15, showing that the upper portion consists of a cylindrical stem portion 16 and a conically configured portion 17 that is connected to the stem portion 16. The transition between the stem portion 16 and the portion 17 is provided by an also conically configured portion 18. The configuration of the inner three-dimensional surface of the tuning plug 15 (see FIG. 5) is identical with the internal configuration of the single-material tuning plug 12 described in relation to FIG. 3 above.

Figure 6:
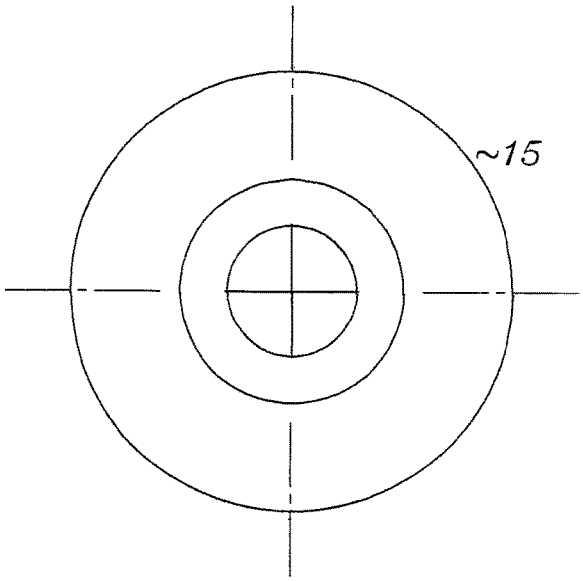
FIG. 6 is a top plan of the two-part tuning plug illustrated in FIG. 4.

In FIG. 6 a top plan view of the tuning plug 15 according to FIG. 4 is shown.

Figure 7:
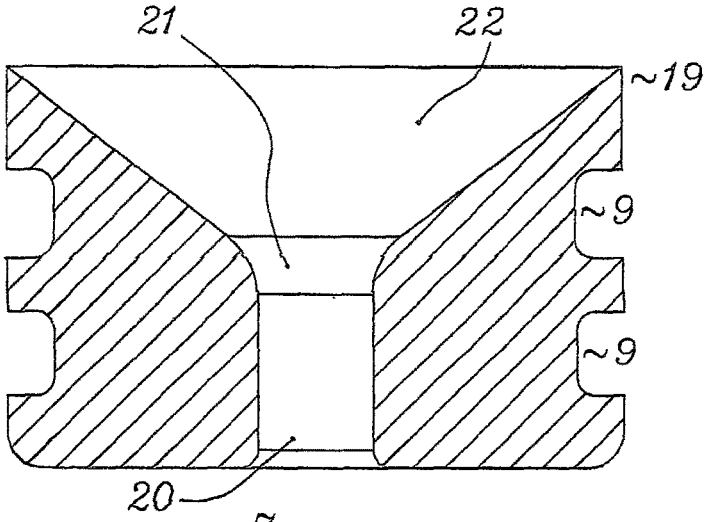
FIG. 7 is a section view of the bottom portion adapted for receiving the upper portion of the two-part tuning plug illustrated in FIG. 4.

FIG. 7 shows a section view of the bottom portion 19 of a bimetallic tuning plug 15. The bottom portion 19 is also configured identically to the external configuration of the tuning plugs 8 and 12, i.e. there are grooves 9 disposed on the cylindrical surface.

The internal configuration of the bottom portion 19 is similar to the configuration illustrated in FIG. 4, i.e. a cylindrical portion 20 adapted for receiving the stem portion 16 is disposed in the bottom portion 19. The cylindrical portion 20 is connected with a portion 21 having a rounded-off flared surface which is terminated in a conical portion 22 that is adapted to support the portion 17 illustrated in FIG. 4.

The components of the tuning plug 15 are assembled by adhesive bonding or soldering, but rubber-ring or screw joints can also be implemented.

FIGS. 8-11 illustrate the configuration of a bimetallic tuning plug comprising a rubber-ring joint.

Figure 8:
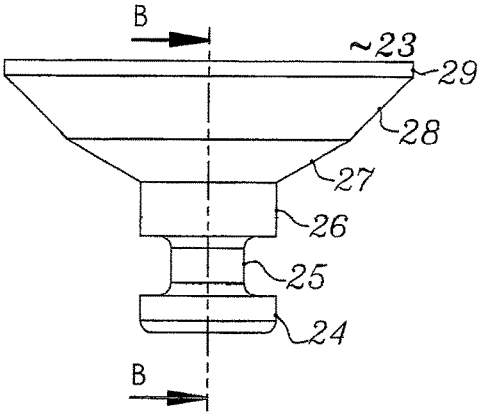
FIG. 8 shows a further embodiment of the two-part tuning plug of the flute headjoint according to the invention.
Figure 9:
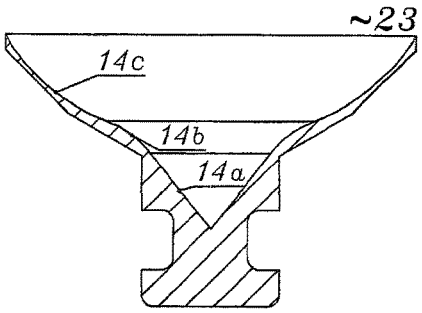
FIG. 9 is a section view of the two-part tuning plug illustrated in FIG. 8, taken along the plane B-B.

In FIG. 8 the upper portion of the tuning plug 23 is illustrated, the bottom portion of which is composed of a head portion 24, a stem portion 25 having a lower diameter than the head portion 24, a cylindrical portion 26 that has a diameter identical to the diameter of the head portion 24 and is connected to the stem portion 25, a conical portion 27, a further conical portion 28 that has a lower cone angle than the conical portion 27 and is connected thereto, and a cylindrical portion 29.

The configuration of the inner three-dimensional surface of the upper portion of the tuning plug 23 is identical to the internal surface configuration of the tuning plug 12 described in relation to FIG. 3 above.

Figure 11:
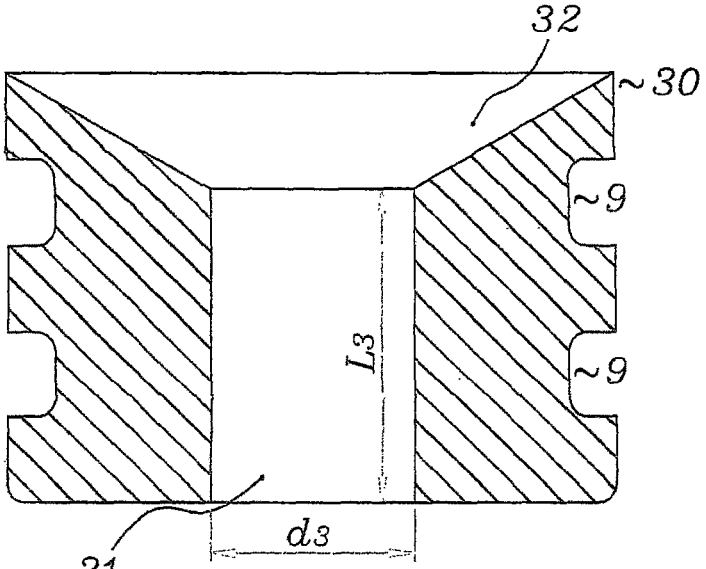
FIG. 11 is a section view of the bottom portion adapted for receiving the upper portion of the two-part tuning plug illustrated in FIG. 8.
Figure 10:
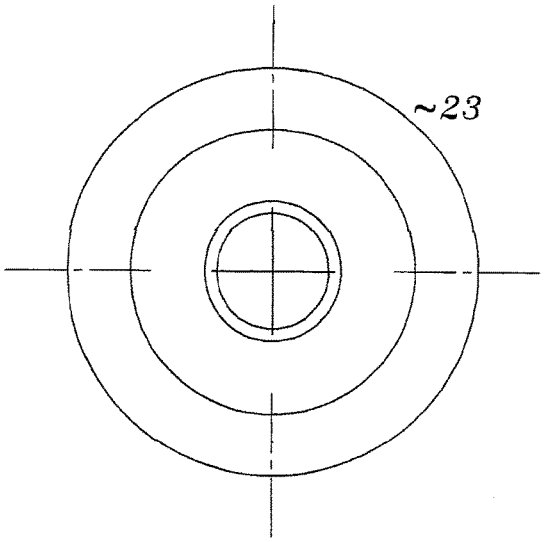
FIG. 10 is a top plan of the two-part tuning plug illustrated in FIG. 8.
Figure 15:
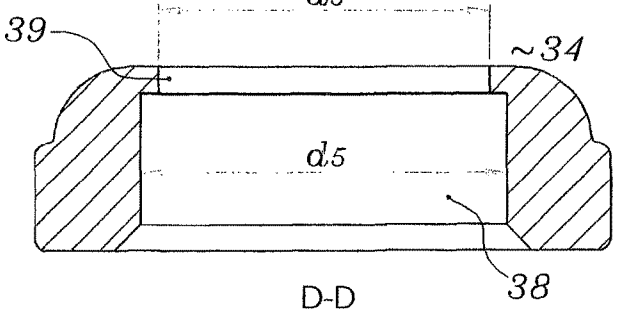
FIG. 15 is a section view, taken along the plane D-D, of the upper portion of the crown illustrated in FIG. 14.

FIG. 10 shows a top plan view of the tuning plug 23, while in FIG. 11 a section view of the bottom portion 30 of the tuning plug 23 is shown.

In the bottom portion 30 there is disposed a bore 31 that is adapted for receiving the head portion 24 of the upper portion, the stem portion 25 and the cylindrical portion 26 and has a diameter of $d_3$=1-44 mm and a depth of $L_3$=2-45 mm.

In the region of the bottom portion 30 that is situated above the bore 31 there can be found a conically configured portion 32 against which the upper portion, i.e. the conical portion 27 is supported.

The tuning plug 23 is assembled by first putting a rubber ring on the stem portion 25 of the upper portion, and then attaching the upper portion and the bottom portion 30. As the head portion 24 is inserted into the bore 31, the rubber ring is adhered to the wall of the bore 31, with the upper portion being be pushed into the bore 31 until the face 27 is fully supported against the portion 32. Being adhered to the wall of the bore 31, the rubber ring keeps the two portions attached.

With such a two-part configuration of the tuning plugs 15 and 23 the upper and bottom portions are made from different metals or metal alloys.

On the one hand this solution allows that a wider timbre range can be achieved by the combination of metals, while it also reduces the cost of the flute because it is now not necessary to make the entire tuning plug of (very expensive) silver or gold.

Thanks to the three-dimensional tuning plug applied in the flute according to the invention a consistently full sound can be achieved. Pitch precision is also significantly improved.

The tuning plug has a very significant influence on the sound produced playing the flute. Different metals have different effects on the quality and the characteristics of the flute sound. The shape of the tuning plug allows that it can be easily and quickly replaced with another one even during a performance, i.e. a different tuning plug—allowing for achieving a timbre and sound quality that better match the next piece—can be inserted into the flute headjoint between the different pieces performed.

Due to the configuration of the tuning plug the crown 6 adapted to close off the instrument at one end can now have an effect on sound quality. It therefore became necessary to replace the conventional crown with a crown having an "open" configuration, i.e. a crown comprising a cylindrical cavity was provided.

In FIGS. 12-15 the crown 6 is illustrated.

The crown 6 consists of two parts, a bottom portion 33 and an upper portion 34.

There is a groove 9 disposed on the outer cylindrical surface of the bottom portion 33. A rubber ring adapted for securing the crown 6 in the flute headjoint 1 is inserted in the groove 9.

Figure 13:
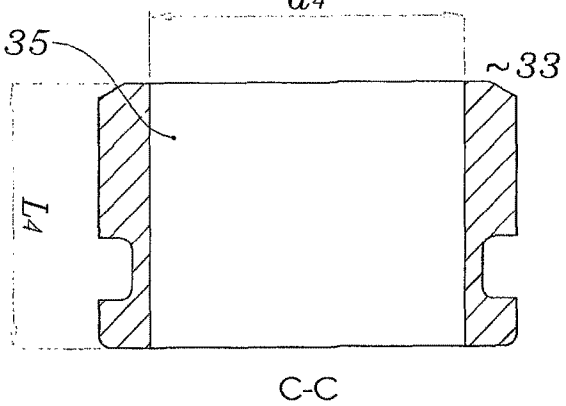
FIG. 13 is a section view, taken along the plane C-C, of the bottom portion of the crown illustrated in FIG. 12.
Figure 14:
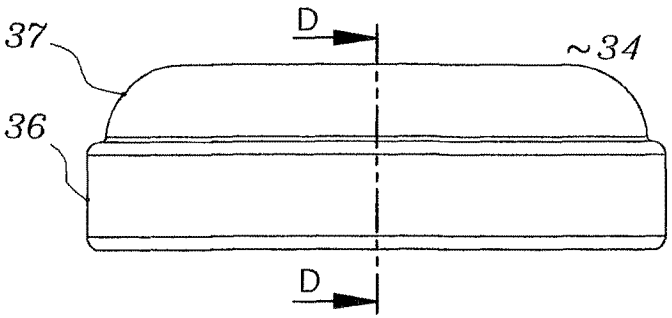
FIG. 14 illustrates the upper portion of the crown of the flute headjoint according to the invention.
Figure 12:
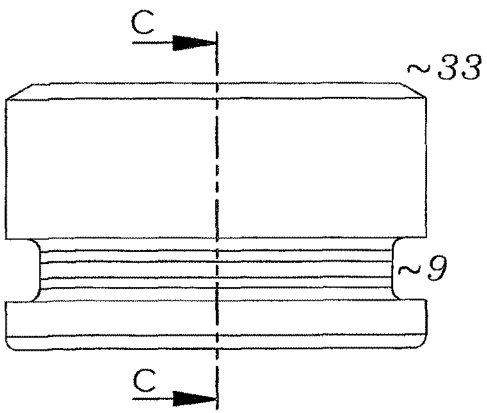
FIG. 12 illustrates the bottom portion of the crown of the flute headjoint according to the invention.

A bore 35 having a diameter $d_4$=1-30 mm and a height $L_4$=3-30 mm extends along the full length of the bottom portion 33 (see FIG. 13).

The upper portion 34 consists of a cylindrical portion 36 and a portion 37 that is connected to the cylindrical portion 36 and is configured with a dome-like shape.

In the upper portion 34 there is disposed a stepped bore 38 adapted to be connected to the bottom portion 33, the bore 38 ending in a narrower cylindrical bore 39. The diameter of the bore 38 is $d_5$=2-32 mm, which finally ends in a bore 39 having a diameter $d_6$=1-30 mm. Between the bottom portion 33 and the upper portion 34 of the crown 6 a membrane (not shown in the drawing) is disposed, the bottom and upper portions 33, 34 being joined by a screw joint.

The membrane can be made of a wide range of materials, such as silver, gold, steel, aluminium, etc.

The crown 6 can also be made from a wide range of different materials, i.e. copper, brass, zirconium, titanium, silver, gold, platinum, tantalum, alpaca, bone, wood, plastic, etc.

The crown has a less significant effect on the sound quality of the flute, but the material of the crown subtly affects the quality of the produced sound. The above described shape of the crown allows that it can be easily and quickly replaced with another one even during a performance, i.e. a different crown can be inserted into the flute headjoint in approximately 30 seconds, which allows for achieving a sound quality that better match the next piece.

The end result of is that the flute according to the invention comprising the novel tuning plug and crown has much better sound quality compared to a conventional flute. For the same amount of in-blown air it has stronger, more dynamic, clearer, more flexible sound; both piano and forte notes can be played more easily. A lot less pitch compensation is necessary.

Large-interval slurs and leaps can also be performed easier. It does no longer pose any difficulty to play low notes loudly and high notes softly.

The tuning plug and crown modified in the above described manner make a very marked difference for players.

The flute headjoint according to the invention can also be provided with additional components that positively affect the use and the sound of the flute.

Such an additional component can be a balance weight 40 inserted into the resonator cavity between the tuning plug and the crown.

In FIG. 16 a conceivable balance weight configuration is illustrated, which is essentially a disc- or ring-shaped body having a diameter of 15-18 mm (corresponding to the diameter of the flute headjoint 1) and a height of $L_5$=1-30 mm.

A groove 41 is machined in the lateral surface of the balance weight 40, with a rubber ring seated in the groove 41 being adapted to retain the balance weight at the desired position.

The balance weight can also be made of a wide range of materials, i.e. of alpaca, aluminium, copper, brass, silver, gold, titanium, zirconium. However, balance weights made of copper, brass or alpaca have to be coated as an anti-corrosion measure and to prevent aluminium oxidation.

Depending on the quality of the flute and according to the needs of the player different effects can be achieved in the sound of the flute by applying a combination of metals. To provide that, multiple different metals or metal alloys may be utilized. Lighter and more pronounced staccato notes (short-duration notes) can be played, or if so desired, a fuller, lighter or more colourful sound quality can be provided. Also, a bigger and richer sound can be achieved with a warmer or cooler timbre.

Figure 17:
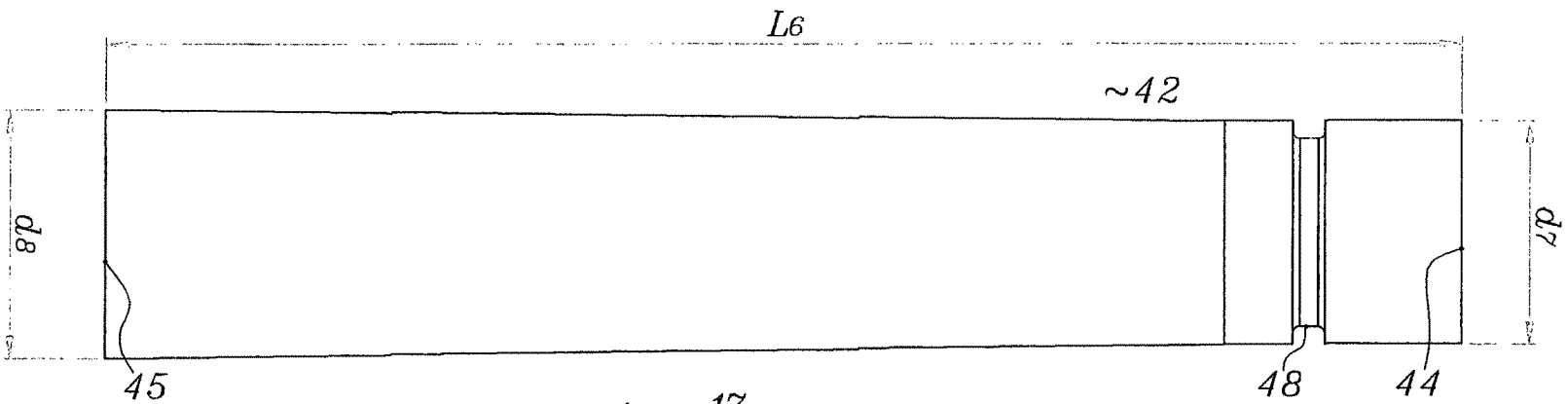
FIG. 17 illustrates an embodiment of the extension piece of the flute headjoint according to the invention.

Finally, by applying an extension piece adapted to be attached to the flute headjoint according to the invention (and to any other flute headjoint manufactured earlier) a special-size flute having a headjoint with greater length than conventional headjoints can be provided. Such extension pieces 42 and 43 are depicted in FIGS. 17 and 18.

The extension pieces 42 and 43 are implemented as thin-walled pipes that are adapted to be temporarily inserted into the flute headjoint 1 replacing the crown 6 and are retained by a rubber ring. Such a solution can be seen in FIG. 17, with the end 44 of the extension piece being connected to the flute headjoint 1 and having a diameter $d_7$=13-16 mm. To attach the extension piece to the flute headjoint 1 a groove 48 adapted to receive a rubber ring is disposed in the proximity of the end 44, the crown being inserted in the upper end 45 having a diameter $d_8$=12-25 mm.

The length of the extension piece 42 is preferably $L_6$=1-28 cm.

Figure 18:
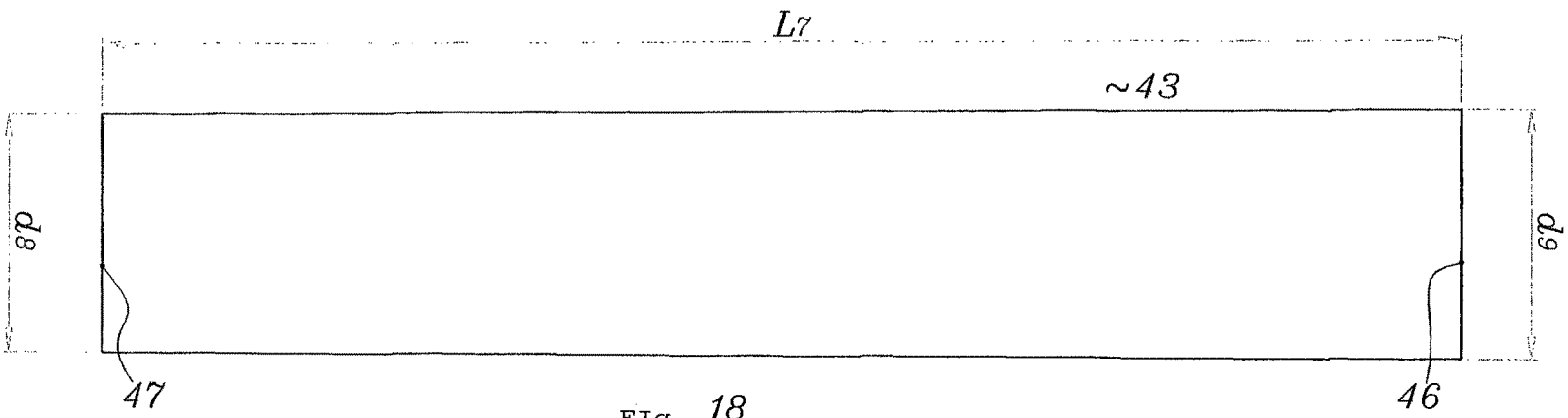
FIG. 18 illustrates another embodiment of the extension piece of the flute headjoint according to the invention.

The extension piece 43 illustrated in FIG. 18 is also implemented as a thin-walled pipe adapted to replace the crown 6 such that it is temporarily placed on the flute headjoint from outside. It has a length $L_7$ between 2 cm and 28 cm. The end 46 adapted to be attached to the flute body from outside has a tapered configuration and a diameter $d_9$=15-30 mm, the crown being inserted in the other end 47.

The extension pieces 42, 43 can be switched quickly and easily, even during a concert.

They can typically be made of copper, brass, alpace, silver, or gold. The metal alloys or high-purity metals provide an improved sound that is different from the average flute sound, is bigger and more beautiful.

The advantages of the flute headjoint according to invention can be summed up as follows:

- applying the open crown the resonator cavity functions as a kind of amplifier, the flute sound being brighter due to the added amount of metal (especially silver),
- with the application of a tuning plug with a three-dimensional tuning surface a fuller, richer, more resonant sound can be achieved in addition to higher sound volume and improved dynamics,
- when redimensioned properly it can be applied for transverse flutes of any tuning and size.

LIST OF REFERENCE NUMERALS

1 flute headjoint
2 pipe section

3 embouchure hole
4 element
5 sonic chamber
5*a* resonator cavity
6 crown
7 free end
8 tuning plug
9 groove
10 end
11 face
12 tuning plug
13 face
14*a* conical portion
14*b* frustum-shaped portion
14*c* flared portion
15 tuning plug
16 stem portion
17 portion
18 portion
19 bottom portion
20 portion
21 portion
22 conical portion
23 tuning plug
24 head portion
25 stem portion
26 cylindrical portion
27 conical portion
28 portion
29 cylindrical portion
30 bottom portion
31 bore
32 portion
33 bottom portion
34 upper portion
35 bore
36 cylindrical portion
37 portion
38 bore
39 portion
40 balance weight
41 groove
42 extension piece
43 extension piece
44 end
45 end
46 end
47 end
48 groove
49 membrane
50 rubber ring

The invention claimed is:

1. Flute headjoint comprising a cylindrical pipe section (2) having a free end (7), an embouchure hole (3) in the pipe section (2) bounded by a reinforcing element (4), a crown (6) terminating the pipe section (2) at an end opposite the free end (7) and a concave tuning plug (8, 12, 15, 23) disposed in the pipe section (2) in a sonic chamber (5) defined in the pipe section (2) under the embouchure hole (3), characterised in that the crown (6) is open in the direction of the pipe section (2) of the flute, the tuning plug (8, 12, 15, 23) is a cylindrical body having a face situated facing the embouchure hole (3), the face having a sunken three-dimensional configuration of a combination of regular or irregular arcuate faces, and the headjoint having a balance weight (40) in a resonator cavity (5*a*) defined in the pipe section (2) between the tuning plug (8, 12, 15, 23) and the crown (6).

2. The flute headjoint according to claim 1, characterised in that the cylindrical pipe section (2) has a length in the range of 220 mm to 450 mm.

3. The flute headjoint (1) according to claim 1, characterised in that the crown (6) consists of two hollow portions, a bottom portion (33) and an upper portion (34), with a membrane being disposed between the bottom and upper portions, and with a groove (9) being disposed on the cylindrical surface of the bottom portion (33).

4. The flute headjoint (1) according to claim 3, characterised in that the bottom (33) and upper portions (34) of the crown (6) are joined together by a releasable connection.

5. The flute headjoint (1) according to claim 1, characterised in that the tuning plug (8) is a cylindrical body comprising grooves (9) adapted for receiving rubber rings disposed on the cylindrical body thereof, with the surface of the tuning plug facing the embouchure hole (3) having an inwardly tapering configuration.

6. The flute headjoint (1) according to claim 1, characterised in that the tuning plug (12) is a cylindrical body comprising grooves (9) disposed on its cylindrical surface, with its face (13) facing the embouchure hole (3) being formed of an inner conical portion (14*a*), a frustum-shaped portion (14*b*) and a concave flared portion (14*c*).

7. The flute headjoint (1) according to claim 1, characterised in that the tuning plug (15, 23) is formed of two portions, an upper and a bottom portion (19, 30).

8. The flute headjoint (1) according to claim 7, characterised in that the upper portion of the tuning plug (12) is formed of a stem portion (16) and an upwardly tapering portion (17) joined to the stem portion (16) via an intermediate portion (18), with a recess consisting of an inner conical portion (14*a*), a frustum-shaped portion (14*b*) and a concave flared portion (14*c*) being disposed in the interior of the upper portion, and with a connection cavity, extending along the entire height of the bottom portion (19), being disposed in the bottom portion (19).

9. The flute headjoint (1) according to claim 8, characterised in that the upper and bottom portion (19) of the tuning plug (15) are joined together firmly or by a releasable connection, by way of example a screw thread.

10. The flute headjoint (1) according to claim 7, characterised in that the upper portion of the tuning plug (23) consists of a head portion (24), a stem portion (25), a cylindrical portion (26), and an outwardly tapering portion (28) terminated in a cylindrical portion (29), with a recess consisting of a inner conical portion (14*a*), a frustum-shaped portion (14*b*) and a concave flared portion (14*c*) being disposed in the interior of the upper portion and with an inner bore (31) adapted for receiving the upper portion and a conical portion (32) connected to the bore (31), being disposed in the bottom portion (30).

11. The flute headjoint (1) according to claim 10, characterised by a releasable connection between the upper and bottom portions (30) of the tuning plug (23).

12. The flute headjoint (1) according to claim 1, characterised by a balance weight (40) in the resonator cavity (5*a*) between the tuning plug (8, 12, 15, 23) and the crown (6), and further including an extension piece (42, 43) in pipe section (2).

13. The flute headjoint (1) according to claim 1, characterised in that the balance weight (40) is a disc- or ring-shaped body comprising one or more grooves (41) adapted for receiving a respective rubber ring.

14. The flute headjoint (1) according to claim 1 wherein pipe section (2) includes a removable extension piece.

15. The flute headjoint (1) according to claim 14, characterised in that the extension piece (42) is a thin-walled pipe, with a groove (48) being disposed at one end (44) thereof, its other end (45) being adapted for receiving the crown (6).

16. The flute headjoint (1) according to claim 14, characterised in that the extension piece (43) is a thin-walled pipe, with the end (46) thereof connected to the flute headjoint (1) having a tapering configuration, its other end (47) being adapted for receiving the crown (6).

17. The flute headjoint (1) according to claim 14, characterised in that the crown (6), the tuning plug (8, 12, 15, 23), the balance weight (40) and the extension piece (42, 43) are made of: gold, silver, alpaca, copper, brass, aluminium, steel, titanium, platinum, tantalum, zirconium, wood, bone, plastic, etc.

18. The flute headjoint (1) according to claim 14, characterised in that the crown (6), the tuning plug (8, 12, 15, 23), the balance weight (40), and the extension piece (42) are attached to the flute headjoint (1) by means of rubber rings disposed in grooves (9, 41, 48) in the cylindrical surface thereof.

* * * * *